United States Patent [19]

Roland et al.

[11] Patent Number: 4,670,723

[45] Date of Patent: Jun. 2, 1987

[54] BROAD BAND, THIN FILM ATTENUATOR AND METHOD FOR CONSTRUCTION THEREOF

[75] Inventors: Leonard A. Roland, Portland; Larry R. Lockwood, McMinnville; H. Erwin Grellmann, Beaverton, all of Oreg.

[73] Assignee: Tektronix, Inc., Beaverton, Oreg.

[21] Appl. No.: 713,134

[22] Filed: Mar. 18, 1985

[51] Int. Cl.[4] ..... H01P 1/22

[52] U.S. Cl. ..... 333/81 A; 333/246

[58] Field of Search ..... 333/81 R, 81 A, 246, 333/172

[56] References Cited

U.S. PATENT DOCUMENTS

| | | | |
|---|---|---|---|
| 3,521,201 | 7/1970 | Veteran | 333/81 A |
| 3,543,197 | 11/1970 | Adam et al. | 333/81 A |
| 4,011,531 | 3/1977 | Gaudet | 333/81 A |
| 4,408,176 | 10/1983 | Rapeli et al. | 333/185 X |

FOREIGN PATENT DOCUMENTS

| | | | |
|---|---|---|---|
| 0084061 | 7/1981 | Japan | 333/81 R |

*Primary Examiner*—Eugene R. LaRoche

*Assistant Examiner*—Benny Lee

*Attorney, Agent, or Firm*—Francis I. Gray; William A. Birdwell

[57] ABSTRACT

A broad band, thin film attenuator for microwave circuits is constructed by placing a ground plane conductor on one side of a ceramic, insulating substrate, and conductive, resistive, and reactive elements on the other side of the substrate. Capacitive stubs are provided to compensate for inductance in grounding conductors between resistance elements and the ground plane conductor. Constrictions are provided in input and output conductors to provide increased series inductance to compensate for distributed capacitance of the resistance elements. One resistance element is constructed so that the interface between the input conductor and that resistance element forms an obtuse interior angle with an adjoining transitional edge extending from the input conductor to the grounding conductor, and the transitional edge forms an obtuse interior angle with the adjoining edge of the grounding conductor, so as to minimize current density concentrations and distributed capacitance. A second resistance element is employed to achieve additional attenuation.

13 Claims, 5 Drawing Figures

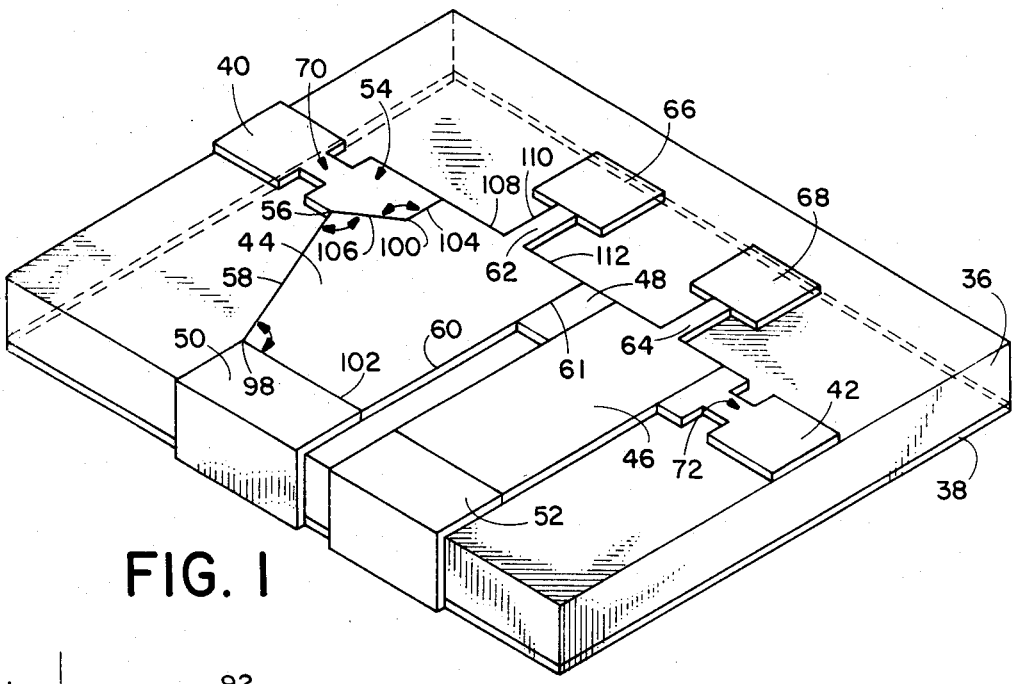
FIG. 1
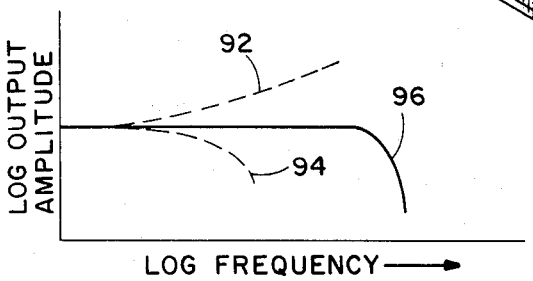
FIG. 4
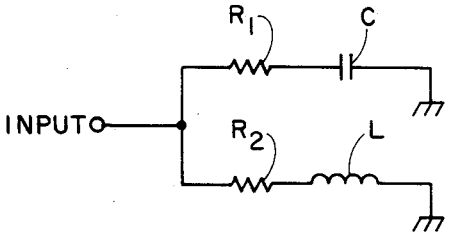
FIG. 3
FIG. 2
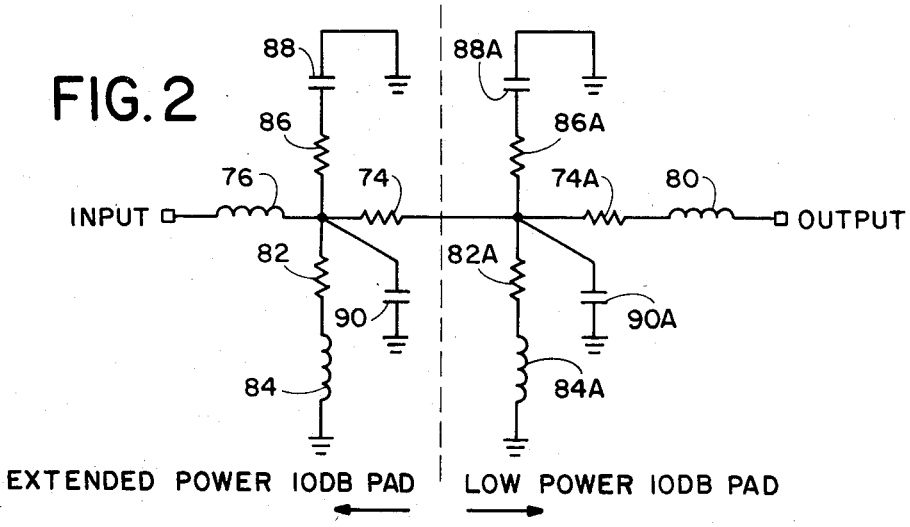

BROAD BAND, THIN FILM ATTENUATOR AND METHOD FOR CONSTRUCTION THEREOF

BACKGROUND OF THE INVENTION

This invention relates to attenuators, particularly broad band, thin film attenuators for microwave applications.

In the construction of microwave circuits it is often desirable to employ an attenuator whose attenuation and input impedance remain constant from DC through the highest frequency that the circuit will experience. Microwave attenuators have been constructed as thin film devices; that is, devices employing a combination of flat conductors and resistive elements separated from a flat ground plane conductor by a thin, typically ceramic, insulating material. However, thin film microwave attenuators heretofore known have had some drawbacks. Typically, above an upper frequency limit their input impedance decreases significantly with increasing frequency. At the same time, their attenuation decreases significantly with increasing frequency.

One type of microwave attenuator that exhibits relatively constant attenuation to a relatively high frequency is a card attenuator of the type shown in Weinschel U.S. Pat. No. 3,157,846. However, such an attenuator also has some drawbacks that limit its usefulness. In particular, the electric field of the microwave signal in the resistive element is concentrated in that portion of the resistive element near the input conductor. As a result, that portion experiences high current density which limits the maximum power dissipation that the attenuator can provide, as excessive power dissipation will destroy the resistive element. Increasing the input contact area to increase power dissipation also increases the distributed capacitance, which lowers the upper frequency limit. Moreover, such a card attenuator employs a cylindrical shield surrounding a plate-like attenuation element and is therefore not physically convenient for all applications.

Accordingly, there is a need for a microwave attenuator, particularly of the thin film type, with improved bandwidth, input impedance characteristics, and power dissipation capability.

SUMMARY OF THE INVENTION

The present invention provides an improved thin film microwave attenuator whose bandwidth is significantly greater than previously known card-type or thin film attenuators, whose input impedance is essentially constant over the operable bandwidth of the attenuator, and whose power dissipation capability is higher than could previously be achieved for the bandwidth of the attenuator. The bandwidth of the thin film attenuator is increased by the use of capacitive stubs to compensate for inductance between the signal conductors and the ground plane thereof, and of input and output conductors shaped to introduce inductance to compensate for the distributed capacitance of the attenuator. Higher power dissipation is achieved in a given attenuation stage by providing a single resistive element for that stage, the resistive element having an optimum shape for distributing current density throughout the element to maximize power dissipation, while keeping the surface area of the element relatively small to minimize distributed capacitance.

The structure of the attenuator employs a substantially flat, insulating substrate made of, for example, quartz or alumina ceramic. A ground plane conductor is disposed on one side of the substrate, while the other elements, that is, resistive elements, capacitive elements, and signal conductors, are disposed on the other side of the substrate. One or more resistive elements, made of a material whose resistance remains substantially constant with temperature, are provided in optimum shapes for the attenuation, bandwidth, and power dissipation required. The resistive elements are electrically connected to input and output ports of the attenuator by flat conductors. They are also connected to the ground plane by respective conductors wrapped around the edge of the substrate. They are further connected to respective capacitor plates at the end of respective protrusions, to form respective stubs. The input and output conductors are provided with constrictions which increase their series inductance.

Accordingly, it is a principal objective of the present invention to provide a novel broad band, thin film attenuator.

It is another objective of the present invention to provide a broad band, thin film attenuator whose attenuation remains substantially constant to a higher frequency than has heretofore been achieved.

It is another objective of the present invention to provide a broad band, thin film attenuator whose input impedance remains substantially constant over its operable bandwidth.

It is a further objective of the present invention to provide a broad band, thin film attenuator whose upper frequency limit for a given power dissipation capability is higher than has heretofore been possible.

The foregoing and other objectives, features, and advantages of the invention will be more readily understood upon consideration of the following detailed description of the invention, taken in conjunction with the accompanying drawings.

BRIEF DESCRIPTION OF THE DRAWINGS

FIG. 1 shows a preferred embodiment of a broad band, thin film attenuator according to the present invention.

FIG. 2 shows a schematic diagram of an electrical model of the attenuator of FIG. 1.

FIG. 3 shows a schematic diagram of a network illustrating a principle employed by the present invention.

FIG. 4 is a graph of attenuator output amplitude as a function of frequency, assuming a constant input amplitude, illustrating the effects of features of the embodiment shown in FIG. 1.

DETAILED DESCRIPTION OF THE INVENTION

Figure 5:
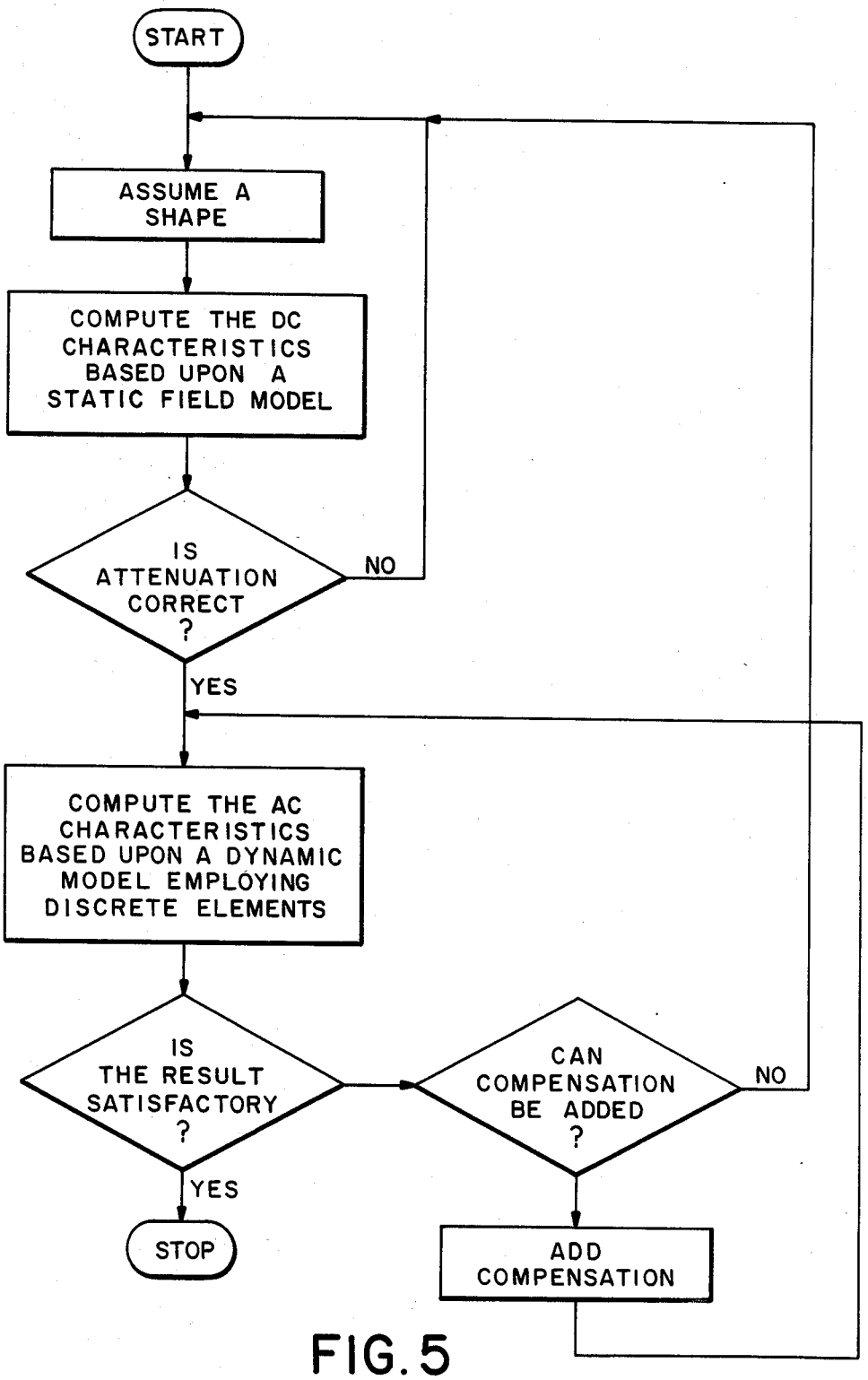
FIG. 5 is a flow diagram of a method employed in the construction of an attenuator according to the present invention.

Referring to FIG. 1, a preferred embodiment of the attenuator invention employs a substantially flat, insulating substrate 36 made of a ceramic, such as quartz ($SiO_2$) or alumina ($Al_2O_3$). A ground plane conductor 38, made of a highly conductive material, such as gold, is disposed on one side of the substrate 36. An input conductor 40 is disposed on the other side of the substrate toward one end thereof and an output conductor 42 is disposed toward the other end. A first resistive element 44 is placed adjacent the input conductor on the same side of the substrate as the input conductor, and a second resistance element 46 is placed adjacent the output conductor, also on the same side of the substrate. The first and second resistive elements are joined by an intermediate conductor 48. A first grounding conductor 50 connects the first resistive element 44 with the ground plane 38 by wrapping around the edge of the substrate 36, and a second grounding conductor 52 similarly connects the second resistance element 46 to the ground plane 38. The input conductor 40, the output conductor 42, the intermediate conductor 48, the first grounding conductor 50, and the second grounding conductor 52 are all made of highly conductive materials, such as gold. The first resistive element 44 and the second resistive element 46 are each made of an element whose resistivity is reasonably constant over a wide range of temperatures, such as a common alloy of nickel and chromium.

The invention employs a first resistive element 44 whose shape is chosen to eliminate concentrations of high current density that would otherwise result in hot spots. In the case of the preferred embodiment shown in FIG. 1, the input conductor 40 connects to the first resistive element 44 at an interface 54 such that the adjoining edges of the input conductor 40 and first resistive element 44 form an obtuse interior angle at corner 56 with a transitional edge 58 of the resistive element that extends between the input conductor 40 and the first grounding conductor 50. The edge 58 also forms an obtuse interior angle with the edge 102 of the grounding conductor 50 at corner 98. Since most of the power is dissipated in the area between the input conductor 40 and the grounding conductor 50, the edge 60 of the resistive element 44 where it connects to the intermediate conductor 48 may be straight and co-linear with the corresponding edge of the first grounding conductor 50. In the embodiment shown, the shape of the first resistive element 44 is an irregular polygon; however, it is to be recognized that other shapes might be employed without departing from the principles of the invention, the important point being that the shape must not only provide the desired attenuation over a broad bandwidth, which requires that the surface area be minimized, but also maximize heat dissipation. It has been found that to achieve these two objectives the transitional edge of the resistive element that extends between the input and ground conductors must form obtuse interior angles with the respective connecting edges of those conductors. In this regard, the term "edge" is intended to include curvilinear as well as rectilinear shapes, and in the case of two intersecting curvilinear edges the angle between a line tangent one edge and another line tangent the other edge immediately adjoining their intersection must be obtuse.

In the preferred embodiment of the invention, two resistive elements are actually employed to achieve the desired attenuation. In this case the total attenuation from input to output is 20dB. An optimum balancing of attenuation with power dissipation can be achieved employing a first resistive element of irregular shape, as shown in FIG. 1, that provides an attenuation of 10dB, and a second resistance element, in an essentially rectangular shape as shown in FIG. 1, that provides additional attenuation of 10dB.

In order to compensate for, that is, to reduce the effect of, inductance in the grounding conductors 50 and 52, the two resistive elements 44 and 46 are provided with respective protrusions 62 and 64 terminated by respective conductive plates 66 and 68 which serve, in conjunction with the ground plane 38, as capacitors. Like the input conductor 40 and the output conductor 42, both plates 66 and 68 are made of a highly conductive material, such as gold. In order to compensate for distributed capacitance of the resistive elements, the input conductor 40 is supplied with an input constriction 70 and the output conductor 42 is supplied with an output constriction 72. These two constrictions increase the series inductance of the input and output conductors, respectively.

Referring now to FIG. 2, as well as FIG. 1, an appropriate electrical model of the attenuator shown in FIG. 1 is a pair of cascaded "L" networks when viewed from the input port 40. At low frequencies the first stage is represented by resistors 74 and 82, and the second stage is represented by resistors 74A and 82A, assuming that the first stage is terminated by the input of the second stage and that the second stage is terminated into a constant impedance. The input impedance of the attenuator and the attenuation of each stage, as represented by the values of the resistors 74 and 82, and 74A and 82A, are determined by the actual current patterns in each stage, which is a function of the size, shape, and resistivity of each resistive element 44 and 46, and of the termination impedance. The termination impedance would typically be nominally 50 ohms.

At higher frequencies the input impedance and attenuation are modified essentially by five factors:

(1) parasitic distributed capacitance, shown lumped in FIG. 2 as capacitors 90 and 90A;

(2) parasitic lead inductance, shown lumped as inductors 84 and 84A, which include conductors 50 and 52 and distributed inductance of the resistive elements 44 and 46, respectively;

(3) inductance resulting from constriction 70 of the input conductor and constriction 80 of the output conductor, shown lumped as inductors 76 and 80, respectively;

(4) compensation capacitors 66 and 68 (the second plate of these capacitors being the backside conductor plane 38), represented by capacitors 88 and 88A, respectively, in FIG. 2; and (5) the resistance in stubs 62 and 64, represented by resistors 86 and 86A, which begin to be added in parallel with resistors 82 and 82A, respectively, as the frequency increases.

Turning to FIG. 3, it can be shown that if $X_C = X_L = R1 = R2$ at some frequency, the impedance to ground seen by the input of the network shown in FIG. 3 will be constant for all frequencies, where:

$X_L$ = impedance of inductor L;

$X_C$ = impedance of capacitor C;

$R_1$ = resistance of resistor $R_1$; and $R_2$ = resistance of resistor $R_2$.

In FIG. 2 resistor 82, inductor 84, resistor 86, and capacitor 88, represent one such network, and resistor 82A, inductor 84A, resistor 86A, and capacitor 88A represent another.

Referring to FIG. 4, were it not for the elements represented by capacitors 88 and 88A, the attenuation would tend to decrease with frequency due to the largely inductive impedance of the grounding conductors resulting in an increase in output amplitude, as shown by line 92. The stubs formed by capacitor plates 66 and 68 and their respective resistive protrusions 62 and 64 compensate for the grounding inductance, and thereby extend the upper frequency limit of the attenuator as shown by line 94 in FIG. 4. However, the output amplitude would tend to drop off as a result of distributed capacitance of the resistive elements, represented by capacitors 90 and 90A, were it not for the introduction of constrictions 70 and 72, in the input and output conductors. The constrictions compensate for the distributed capacitance so as to extend the bandwidth further, as shown by line 96 in FIG. 4.

Turning to FIG. 5, the shape of the first resistive element 44 is found by a combination of educated assumptions and trial and error, preferably using computer implemented field and network analysis models. As shown by the flow chart in FIG. 5 a reasonable assumption regarding an appropriate shape for the resistive element is first made based upon desired transfer characteristics, principally attenuation, input and output impedances of the attenuator, and a given resistivity for the resistance element material. A static electric field model of the resistive element is then selected. Based upon that model the DC characteristics of the resistive element, that is, the input resistance, the output resistance, and the attenuation, principally, are computed using techniques commonly known to those skilled in the art. For example, a computer program known as SUPERB, provided by Structural Dynamics Research Corporation of Ohio, can be employed to make such a computation. If the characteristics are not satisfactory a new shape is assumed and the computation is performed again.

Assuming that the DC characteristics are satisfactory, a dynamic model of the resistance element is prepared employing a network of discrete elements. The AC characteristics of the element, that is, the input impedance, the output impedance, and the attenuation, principally, are then computed using techniques commonly known to those skilled in the art. For example, a computer program known as SUPERCOMPACT provided by Compact Engineering, Inc., of Palo Alto, Calif. can be employed to make such a computation. If the result is unsatisfactory one must decide whether it appears that compensating reactance elements could be added to produce satisfactory results. If not, a new shape is assumed and the process is started over. If it appears that compensating elements can be added, that is done, and the AC characteristics are again computed. This process is followed until satisfactory static and dynamic results are obtained.

By way of example, but not of limitation, it has been found that for an attenuator having a bandwidth of 40 gigahertz, and the ability to dissipate greater than one watt when provided with an appropriate heat sink, a first resistive element 44, as shown in FIG. 1, can be employed using a nickel-chromium alloy having a sheet resistivity of 50 ohms/square. The shape of the first resistive element 44, as shown in FIG. 1, is defined as follows:

| CORNERS | |
|---|---|
| Corner | Angle |
| Corner 56 | 97.12° |
| Corner 98 | 126.66° |
| Corner 100 | 133.78° |

All other corners have angles of 90 degrees.

| EDGES | |
|---|---|
| Edge | Length |
| Edge 58 | .0268 inches |
| Edge 60 (from 102 to 112) | .0430 inches |
| Edge 61 (width of conductor 48) | .0215 inches |
| Edge 102 | .0240 inches |
| Edge 104 | .0100 inches |
| Edge 106 | .0166 inches |
| Edge 108 | .0120 inches |
| Edge 110 | .0120 inches |
| Edge 112 | .0120 inches |

It is to be recognized that while the foregoing dimensions exemplify a first resistive element providing attenuation of 10dB, there is no single solution for the design of such an element, or of a resistive element having different characteristics, in accordance with the principles of the present invention.

The terms and expressions which have been employed in the foregoing specification are used therein as terms of description and not of limitation, and there is no intention in the use of such terms and expressions of excluding equivalents of the features shown and described or portions thereof, it being recognized that the scope of the invention is defined and limited only by claims which follow.

We claim:

1. An attenuator, comprising:

(a) an insulator having two substantially parallel sides;

(b) a ground plane conductor disposed on a first of said two parallel sides;

(c) a first resistive conductor disposed on the second of said two parallel sides, said first resistive conductor having an input edge, an output edge, a ground edge, and a stub edge;

(d) an input conductor disposed on the second of said two parallel sides and electrically connected to said input edge of said first resistive conductor;

(e) a first output conductor disposed on the second of said two parallel sides and electrically connected to said output edge of said first resistive conductor;

(f) a first grounding conductor electrically connected between said ground edge of said first resistive conductor and said ground plane conductor; and (g) a first capacitive conductor disposed on the second of said two parallel sides and electrically connected to said stub edge of said first resistive conductor for producing capacitance between said first capacitive conductor and said ground plane conductor.

2. The attenuator of claim 1 wherein said stub edge comprises a protrusion of said first resistive conductor, said capacitive conductor being electrically connected to said stub edge at the end of said protrusion.

3. The attenuator of claim 1 wherein at least one of said input and output conductors has a constriction for increasing the series inductance thereof.

4. The attenuator of claim 1, further comprising a second resistive conductor disposed on the second of said two parallel sides, said second resistive conductor having an input edge, an output edge, a ground edge, and a stub edge, said input edge thereof being electrically connected to said first output conductor, a second output conductor disposed on the second side of said two parallel sides and electrically connected to said output edge of said second resistive conductor, and a second grounding conductor connected between said ground edge of said second resistive conductor and said ground plane conductor.

5. The attenuator of claim 4, further comprising a second capacitive conductor disposed on the second of said two parallel sides and electrically connected to said stub edge of said second resistive conductor.

6. The attenuator of claim 1 wherein said first resistive conductor includes a transition edge between said input edge thereof and said ground edge thereof, the respective interior angles between said input edge and said transition edge and between said transition edge and said ground edge, immediately adjacent the points where they intersect, being obtuse.

7. The attenuator of claim 6 wherein at least one of said input and output conductors has a constriction for increasing the series inductance thereof.

8. The attenuator of claim 7 wherein the shape of said first resistive conductor is rectilinear and said ground edge joins said output edge at a substantially right interior angle, said output edge joins said stub edge at a substantially right interior angle, said input edge has a first section joining said transition edge and a second section joining said stub edge at a substantially right interior angle and joining said first section, and said stub edge comprises a protrusion of said first resistive conductor, said first capacitive conductor being electrically connected to said stub edge at the end of said protrusion.

9. The attenuator of claim 8, further comprising a second resistive conductor disposed on the second of said two parallel sides, said second resistive conductor having an input edge, an output edge, a ground edge, and a stub edge, said input edge being electrically connected to said first output conductor, a second output conductor disposed on the second side of said two parallel sides and electrically connected to said output edge of said second resistive conductor, and a second grounding conductor connected between said ground edge of said second resistive conductor and said ground plane conductor.

10. An attenuator, comprising: p1 (a) a ground conductor; p1 (b) an input conductor spaced from said ground conductor and disposed substantially parallel thereto;

(c) an output conductor spaced from said ground conductor and disposed substantially parallel thereto; and (d) a resistive conductor having an input edge electrically connected to said input conductor, an output edge electrically connected to said output conductor, a ground edge electrically connected to said ground conductor, a stub edge extending between said input edge and said output edge opposite said ground edge, the respective interior angles between said stub edge and said input edge and between said stub edge and said output edge being substantially right angles, and a transition edge extending between said input edge and said ground edge, the respective interior angles between said input edge and said transition edge immediately adjacent their intersection and between said ground edge and said transition edge immediately adjacent their intersection being obtuse, said ground edge joining said output edge at a substantially right interior angle, the shape of said resistive conductor being rectilinear.

11. The attenuator of claim 10 further comprising an insulator having two substantially parallel sides, said ground conductor being disposed on a first of said two parallel sides, and said input conductor, output conductor, and resistive conductor being disposed on the second of said two parallel sides.

12. A method for constructing an attenuator comprising the steps of:

(a) selecting an appropriate shape for a resistive element having an input edge, an output edge and a ground edge based upon desired attentuation and input and output impedances for said attenuator;

(b) computing the DC attenuation and input and output resistances of said resistive element;

(c) comparing the attenuation and resistances computed in step (b) with predetermined acceptable DC tolerances;

(d) repeating steps (a)–(c) until the attenuation and resistance computed in step (b) fall within said predetermined acceptable DC tolerances;

(e) then computing the AC attenuation and input and output impedances of said resistive element;

(f) comparing the attenuation and impedances computed in step (e) to predetermined acceptable AC tolerances;

(g) repeating steps (a)–(f) until the attenuation impedances computed in step (e) are within said predetermined acceptable AC tolerances;

(h) then forming a resistive element of the last shape selected; and (i) connecting input, output and ground conductors to said resistive element.

13. The method of claim 12 further comprising between steps (f) and (g) the step of:

if the attenuation and impedances computed in step (e) fall outside said predetermined acceptable AC tolerances, repeating steps (e) and (f) after assuming that selected compensating reactance elements have been connected to said resistive elements until the attenuation and impedances computed in step (e) fall within said predetermined acceptable AC tolerances or no improvement in the attenuation and impedances computed in step (e) can be achieved by adding compensating reactance elements, and wherein step (g) includes repeating step (j) after step (f).

* * * * *